United States Patent [19]

Wiewiorowski et al.

[11] 3,975,497

[45] Aug. 17, 1976

[54] ENHANCED SELECTIVITY IN THE SEPARATION OF NICKEL AND COBALT FROM AMMONIACAL SOLUTIONS

[75] Inventors: Tadeusz K. Wiewiorowski, New Orleans; David J. Miller, Gretna, both of La.

[73] Assignee: Freeport Minerals Company, New York, N.Y.

[22] Filed: May 19, 1975

[21] Appl. No.: 578,655

Related U.S. Application Data

[63] Continuation-in-part of Ser. No. 487,559, July 11, 1974, abandoned.

[52] U.S. Cl. ..... 423/140; 423/143

[51] Int. Cl.[2] ..... C01G 51/00; C01G 53/12

[58] Field of Search ..... 423/140, 142, 143; 75/103, 119, 108

[56] References Cited

UNITED STATES PATENTS

| | | | |
|---|---|---|---|
| 3,088,803 | 5/1963 | Mackiw et al. | 423/142 X |
| 3,720,750 | 3/1973 | Wiewiorowski et al. | 423/140 X |
| 3,821,354 | 6/1974 | Gandon et al. | 75/119 X |

OTHER PUBLICATIONS

Bjerrum, J., *Metal Ammine Formation in Aqueous Solution*, P. Haase & Son, Copenhagen, (1941), pp. 180–198.

*Primary Examiner*—Herbert T. Carter
*Assistant Examiner*—Brian E. Hearn
*Attorney, Agent, or Firm*—Ronald A. Schapira

[57] ABSTRACT

An ammoniacal solution containing nickel and cobalt dissolved as nickel-ammonia complexes and cobalt-ammonia complexes is treated with a material capable of providing free ammonia in the solution, such as gaseous ammonia or aqueous ammonia, in order to increase the proportion of higher nickel-ammonia complexes to lower nickel-ammonia complexes in solution until at least about 85% of the dissolved nickel is in the form of higher nickel-ammonia complexes, i.e., complexes in which the number of $NH_3$ molecules is greater than 3. The attainment of this high concentration of higher nickel-ammonia complexes is readily determined by various analytical procedures such as, for example, free ammonia electrode measurements and spectrophotometer measurements. The solution is then treated with a sulfiding agent in an amount sufficient to selectively precipitate out the dissolved cobalt as cobalt sulfide. The resulting slurry is separated into a nickel-enriched liquid fraction and a cobalt-enriched solids fraction. Surprisingly, when the dissolved nickel is present as a higher ammonia complex, less tends to undesirably coprecipitate with the cobalt during sulfiding. The highly desirable result is a precipitate containing up to 50% more cobalt and 20% less nickel, and a mother liquor more enriched in nickel, than normally obtained in a conventional selective sulfiding.

19 Claims, 2 Drawing Figures

PERCENTAGE OF DISSOLVED NICKEL PRESENT AS HIGHER NICKEL-AMMONIA COMPLEXES IN SOLUTION VS. FREE AMMONIA CONTENT OF SOLUTION

FIG.2 PERCENTAGE OF DISSOLVED NICKEL PRESENT AS HIGHER NICKEL-AMMONIA COMPLEXES IN SOLUTION VS. AVERAGE WAVELENGTH OF MAXIMUM LIGHT ABSORPTION OF SOLUTION
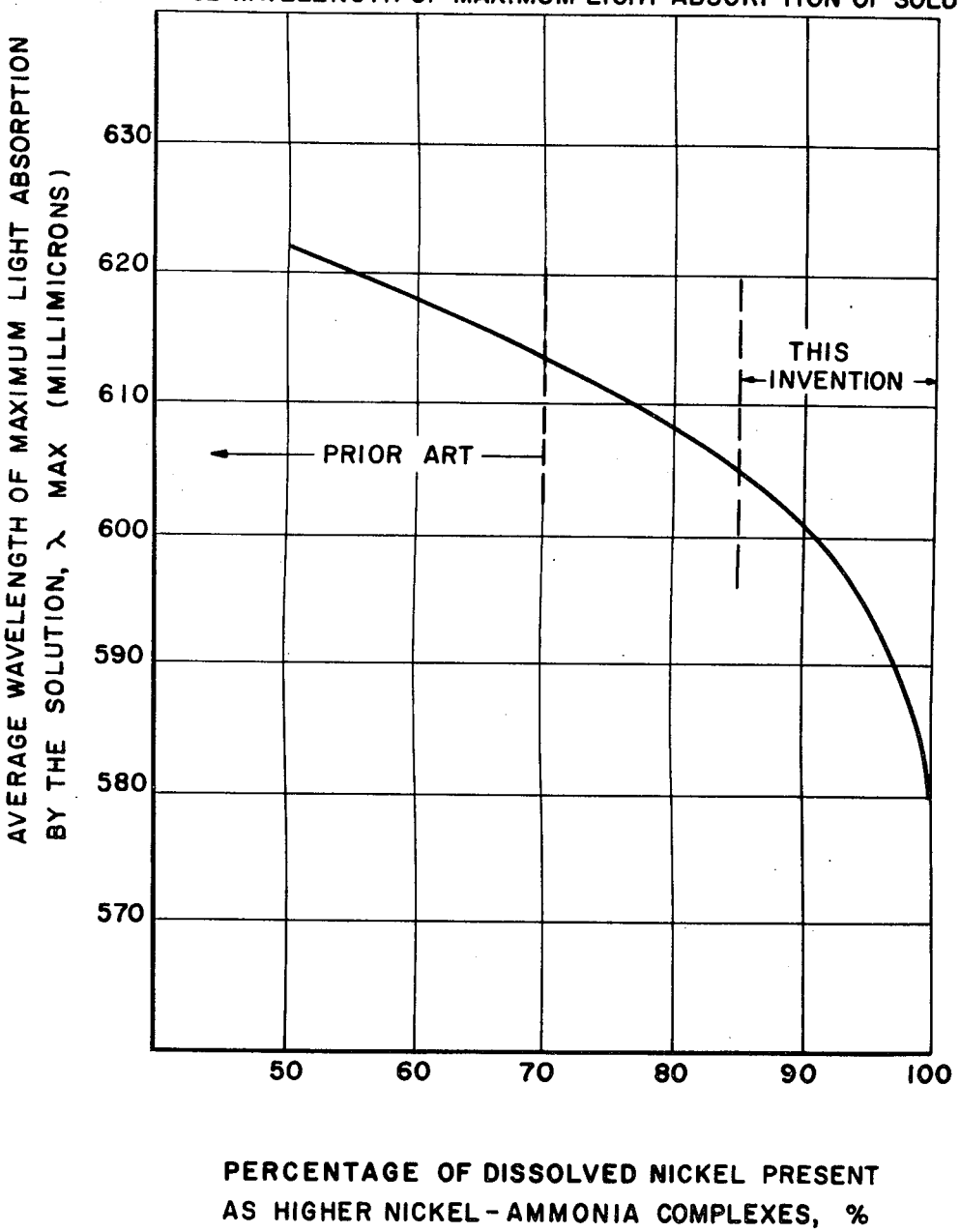

ENHANCED SELECTIVITY IN THE SEPARATION OF NICKEL AND COBALT FROM AMMONIACAL SOLUTIONS

CROSS REFERENCE TO RELATED APPLICATIONS

This application is a continuation-in-part of application Ser. No. 487,559, filed July 11, 1974, now abandoned.

BACKGROUND OF THE INVENTION

This invention relates to the recovery of nickel and cobalt from aqueous ammoniacal solutions containing these metals.

Numerous nickel and cobalt-enriched ammoniacal solutions are known to those skilled in the art. For example, ammoniacal carbonate solutions containing nickel and cobalt are produced commercially by heating cobalt-containing nickeliferous ores in a furnace with a reductant gas and then leaching the reduced ores in the presence of oxygen with an aqueous solution of ammonium hydroxide and ammonium carbonate. As in known, the nickel and cobalt values in the ore dissolve in the solution as nickel-ammonia complexes and cobalt-ammonia complexes. Examples of the production of such ammoniacal carbonate solutions are described in detail in U.S. Pat. Nos. 1,487,145 and 3,100,700, and in "The Winning of Nickel", J. R. Boldt, Jr., Van Nostrand Co., Inc., Princeton, N.J. (1967), pp. 425–537.

Ammoniacal chloride solutions containing nickel and cobalt are prepared by leaching reduced lateritic ores with an aqueous leach liquor containing ammonium hydroxide and ammonium chloride. Ammoniacal chloride solutions are also prepared by dissolving or redissolving a nickel and cobalt containing material such as a nickel matte, a basic nickel carbonate, mixtures of nickel carbonates and cobalt carbonates, a nickel oxide, nickel scrap, a nickel alloy or mixtures of nickel sulfide and cobalt sulfide containing nickel and cobalt in varying proportions, in an aqueous solution of ammonium hydroxide and ammonium chloride, or in aqueous hydrochloric acid followed by adjustment of the solution pH to above 7 and normally above 8, with ammonia.

Ammoniacal sulfate solutions containing nickel and cobalt are prepared by leaching reduced lateritic ores with an aqueous leach liquor containing ammonium hydroxide and ammonium sulfate. Ammoniacal sulfate solutions are also prepared by dissolving or redissolving a nickel and cobalt-containing material such as a nickel matte, a basic nickel carbonate, mixtures of nickel carbonates and cobalt carbonates, a nickel oxide, a nickel alloy, nickel scrap, mixtures of nickel sulfide and cobalt sulfide containing nickel and cobalt in varying proportions, in an aqueous solution of ammonium hydroxide and ammonium sulfate, or in aqueous sulfuric acid followed by adjustment of the solution pH to above 7, and normally above 8, with ammonia.

As is known, the nickel and cobalt values dissolve in such ammoniacal solutions as nickel-ammonia complexes and cobalt-ammonia complexes.

Since it is commercially desirable to separate the cobalt from the nickel, numerous separation processes have been developed. In one known process, the ammoniacal solutions containing the cobalt and nickel are treated with a sulfiding agent, the objective being to selectively precipitate the cobalt as cobalt sulfide while leaving the nickel dissolved in the mother liquor. This separation technique is based upon the known principle that cobalt sulfide tends to precipitate in advance of the nickel sulfide under properly controlled sulfiding conditions. Unfortunately, however, substantial amounts of nickel sulfide ordinarily coprecipitate with the cobalt sulfide. This is undesirable because the proportion of cobalt in the precipitate is diminished thus making recovery of the cobalt more difficult. Moreover, the mother liquor, which is the source of recovered nickel values, has had its nickel content substantially diminished by the coprecipitation of nickel sulfide with the cobalt sulfide. It is apparent, therefore, that a method for retaining as much nickel as possible dissolved in the ammoniacal solution during sulfiding would be most desirable, as would a method for enriching the cobalt content of the sulfide precipitate.

It is an object of this invention, therefore, to provide a method for improving the selectivity of the separation of the cobalt from the nickel during the sulfiding of ammoniacal solutions containing dissolved nickel and cobalt.

It is another object of the invention to provide a method for separating cobalt from the nickel dissolved in an aqueous ammoniacal solution, using a sulfiding treatment, by which coprecipitation of nickel sulfide with the cobalt sulfide is minimized, thereby retaining more nickel in the mother liquor and producing a precipitate of enriched cobalt content.

It is another object of the invention to provide a method for increasing the amount of cobalt which precipitates during the selective sulfiding of aqueous ammoniacal solutions containing nickel and cobalt without simultaneously increasing the amount of nickel which coprecipitates with the cobalt.

It is a further object of the invention to provide a method for altering the chemical form of the nickel dissolved in aqueous ammoniacal solutions prior to selectively sulfiding such solutions, whereby more nickel remains in solution during sulfiding, and consequently less coprecipitates with the cobalt.

These and other objects of the invention will be apparent to those skilled in the art from a consideration of this entire specification.

SUMMARY OF THE INVENTION

The above objectives are accomplished, in accordance with the present invention, by converting most of the lower nickel-ammonia complexes normally present in the aqueous ammoniacal solutions to higher-ammonia complexes before the solutions are sulfided so that the proportion of higher nickel-ammonia complexes to lower nickel-ammonia complexes is increased to the point where at least about 85% of the nickel in solution is in the form of higher nickel-ammonia complexes at the time sulfiding of the solution is initiated. It has been surprisingly found that the increase in the proportion of the higher nickel complexes to the lower nickel complexes present in the solution has the highly beneficial effects of not only decreasing the amount of nickel coprecipitated with the cobalt during the subsequent sulfiding of the solution but also of increasing the amount of the cobalt which is precipitated.

The nickel-ammonia complexes whose proportions are altered by the practice of the invention are the complex ions which are known to form upon the leaching and aeration of the reduced nickeliferous ore with the ammoniacal carbonate leach solution. These complexes exist in the form of lower nickel-ammonia complexes, that is, ions which are combined with a low number, e.g., 1, 2 and 3, of ammonia molecules and higher nickel-ammonia complexes, that is, ions which are combined with a high number, e.g., 4, 5 and 6, of ammonia molecules. Some illustrative lower nickel-ammonia complexes are $Ni(NH_3)(H_2O)_5^{++}$, $Ni(NH_3)_2(H_2O)_4^{++}$ and $Ni(NH_3)_3(H_2O)_3^{++}$. Some illustrative higher nickel-ammonia complexes are $Ni(NH_3)_4(H_2O)_2^{++}$, $Ni(NH_3)_5(H_2O)^{++}$ and $Ni(NH_3)_6^{++}$. The cobalt-ammonia complexes formed during leaching exist mostly in the form of higher complexes such as $Co(NH_3)_5(H_2O)^{+++}$ and $Co(NH_3)_6^{+++}$. The nickel-ammonia and cobalt-ammonia complex ions are also referred to by those skilled in the art by the terms "nickel ammine complexes" and "cobalt ammine complexes", respectively. Prior to sulfiding, conventional ammoniacal solutions have a distribution of lower to higher complexes in which only about 65–70%, or less, of the dissolved nickel content is present as the higher nickel-ammonia complexes, levels far below those at which the beneficial effects of this invention take place.

The proportion of higher to lower nickel-ammonia complexes can be increased to the desired level, in accordance with the invention, by treating the solution, prior to sulfiding, with any material capable of providing free ammonia in the solution. Thus a material which makes a direct addition of free ammonia to the solution as well as those which generate free ammonia in situ in the solution can be added to the aqueous ammoniacal solutions with highly satisfactory results. The term "free ammonia", as used herein, refers to ammonia which in solution is uncombined, that is, the ammonia present as $NH_3$, as opposed to that present or combined in the form of ammonium hydroxide or ammonium salts such as ammonium carbonate, ammonium chloride and ammonium sulfate, or in complex metal ions such as $Ni(NH_3)_4(H_2O)_2^{++}$ and $Co(NH_3)_6^{+++}$. Normally, the ammoniacal solutions upon which the method of the invention is practiced have a concentration of free ammonia of only about 7 grams per liter (gpl) of solution or less. The free ammonia concentration may be measured, in accordance with known techniques and procedures discussed in more detail below, by inserting a specific ion electrode, which detects only the $NH_3$ species in solution, into the ammoniacal solution. Free ammonia is not to be confused with "total ammonia" which, as used herein, refers to the ammonia in solution which is combined in the form of ammonium salts, ammonium hydroxide, and complex metal ions plus the amount which is present as uncombined "free ammonia".

It has been found, for example, that gaseous ammonia and solutions of aqueous ammonia, particularly concentrated solutions, are effective sources of free ammonia and that the proportion of higher to lower nickel complexes can therefore be greatly increased, in accordance with the invention, by treating the solution, before it is sulfided, with gaseous ammonia or a solution of aqueous ammonia in an amount effective to reduce the amount of nickel coprecipitated with the cobalt when the treated solution is subsequently sulfided. Illustratively, enough ammonia or other additive capable of providing the free ammonia in solution is added to raise the free ammonia content from its normal concentration of about 7 grams per liter or less to at least about 10, and preferably at least about 13, grams per liter.

It has also been found that the amount of higher nickel complexes in these solutions can be conveniently measured by light absorption techniques in which light of varying wave length is passed through the solutions and the wave length noted at which maximum light absorption by the solutions takes place. In the ammoniacal solutions upon which the invention is practiced, maximum light absorption usually takes place at wave lengths of about 615 millimicrons or higher. However, in the solutions produced by the present invention, which contain a far higher proportion of higher to lower nickel-ammonia complexes, maximum light absorption occurs at wave lengths of about 605 millimicrons or lower, and in the preferred solutions of the invention, at wavelengths of about 601 or lower. Thus the amount of the free ammonia producing additive required can also be expressed in terms of the amount required to reduce the wave length of maximum absorption from about 615 millimicrons or higher to about 605 millimicrons or less, and preferably to about 601 millimicrons or less.

Thus the method of this invention may illustratively be carried out by injecting a material capable of providing free ammonia into the ammoniacal solution, prior to sulfiding, and measuring the proportion of higher nickel-ammonia complexes to lower nickel-ammonia complexes in solution, regulating the amount of free ammonia producing additive injected so as to increase the proportion of higher nickel-ammonia complexes to lower nickel-ammonia complexes in solution to a point where at least about 85% of the dissolved nickel is in the form of the higher nickel-ammonia complexes, as measured either by the concentration of free ammonia in solution or the measured wave length of maximum light absorption, and further treating the injected solution with a sulfiding agent in an amount sufficient to selectively precipitate the cobalt as cobalt sulfide.

It has been found that the treatment of ammoniacal solutions of nickel and cobalt, prior to selective sulfiding, with additives such as gaseous ammonia or a solution of aqueous ammonia significantly increases proportion of the higher nickel-ammonia complexes to the lower nickel-ammonia complexes present in these solutions and, furthermore, that this increase has the above-mentioned unexpected desirable effect of substantially decreasing the amount of nickel coprecipitated with the cobalt during sulfiding. The practice of the invention also provides a more complete precipitation of the cobalt as cobalt sulfide without a corresponding undesirable increase in the amount of nickel coprecipitated with the cobalt. The overall result is a precipitate which contains not only a higher overall cobalt content but also a higher concentration of cobalt, as well as a mother liquor which contains not only a higher overall nickel content but also a higher concentration of nickel. The method of the invention has illustratively provided precipitates containing up to about 50% more cobalt and about 20% less nickel than those precipitates produced by conventional processes which do not make use of the invention. By way of further illustration of the extent of the improvement obtained, the nickel to cobalt ratios in the sulfide precipitate are only about 0.5 to 2.5 when the present invention is used as compared to typical ratios of about 2.5 to 4 using conventional sulfiding techniques. Similarly, the nickel to cobalt ratio in the filtrate from the sulfiding operation is about 500 to 1000 when the present invention is used as compared to typical ratios of only about 50 to 250 using conventional sulfiding techniques. These desirable nickel to cobalt ratios vividly demonstrate that less nickel and more cobalt is in the precipitate, as desired, and more nickel and less cobalt is in the filtrate, again as desired.

The treatment with gaseous ammonia, or strong solution of aqueous ammonia, surprisingly, produces no detrimental effect on the prcipitation of the cobalt in solution. The complexed cobalt in solution after ammonia addition and prior to sulfiding remains mostly as $Co(NH_3)_5(H_2O)^{+++}$ and $Co(NH_3)_6^{+++}$, with no significant increase in the concentration of the higher complex $Co(NH_3)_6^{+++}$.

The invention is described in greater detail below in connection with the preferred embodiments thereof and the accompanying drawings.

BRIEF DESCRIPTION OF THE DRAWINGS

FIG. 2 is a graph showing a correlation between the amount of dissolved nickel in solution present as higher nickel-ammonia complexes and the average wavelength at which maximum light absorption by the solution occurs.

FIGS. 1 and 2 are useful tools for determining when a sufficient amount of free ammonia producing additive has been added to the solution to increase the amount of dissolved nickel present as higher nickel - ammonia complexes to at least about 85%, in accordance with the requirements of the invention.

DESCRIPTION OF THE PREFERRED EMBODIMENTS

Figure 1:
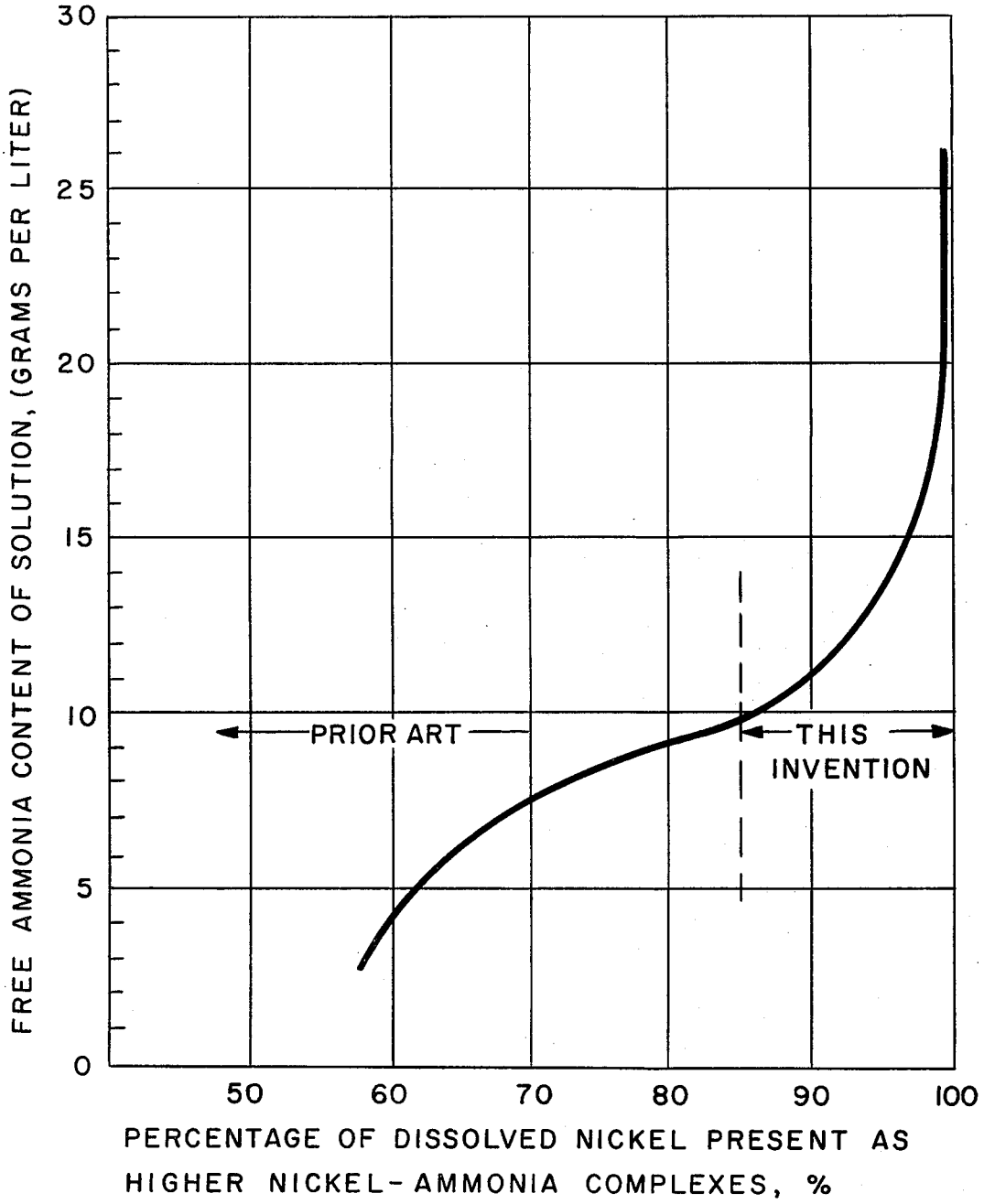
FIG. 1 is a graph showing a correlation between the amount of dissolved nickel in solution present as higher nickel-ammonia complexes and the concentration of free ammonia in solution.

In one preferred embodiment of the invention, the aqueous ammoniacal solutions treated with the free ammonia producing additive are those typically prepared in the conventional ammoniacal leaching of a reduced nickeliferous ore containing nickel and cobalt values. Illustratively these solutions have a total, i.e., free plus combined, ammonia content of between about 60 and 80, and preferably about 70, grams per liter (gpl), expressed as $NH_3$.The nickel content of the solutions is illustratively between about 4 and 150 grams per liter, and preferably between about 10 and 80 grams per liter. Their cobalt content is illustratively between about 0.05 and 5 grams per liter, and preferably between about 0.5 and 2 grams per liter.

The ammoniacal carbonate solutions which may be benefited by the method of the invention are not limited to those produced by the high temperature reduction and atmospheric leaching previously described. Similar ammoniacal carbonate solutions which are also suitable for treatment in accordance with the invention include those produced by the pressure leaching of cobalt-containing nickeliferous ores with ammonium hydroxide-ammonia carbonate solutions at relatively low temperatures, those produced by the redissolution of basic nickel and cobalt carbonates into ammonium hydroxide-ammonium carbonate solutions, and the like. Such solutions are often encountered at different stages of the various processes for the recovery of nickel and cobalt from nickeliferous ores by hydrometallurgical techniques, as is appreciated by those skilled in the art.

The aqueous ammoniacal solution upon which the invention is practiced may also be a nickel and cobalt-enriched ammoniacal chloride solution or ammoniacal sulfate solution of the types previously described.

Ammoniacal chloride solutions prepared by leaching lateritic ores with an aqueous ammoniun hydroxide-ammonium chloride leach liquor have the following illustrative compositions:

| | grams per liter |
|---|---|
| total ammonia | 50–100 |
| chloride, as Cl | 30–90 |
| nickel | 5–20 |
| cobalt | 0.2–2 |

while those prepared by the dissolution or redissolution technique described above have the following illustrative compositions:

| | grams per liter |
|---|---|
| total ammonia | 10–200 |
| chloride, as Cl | 0.3–40 |
| nickel | 0.2–100 |
| cobalt | 0.2–100 |

Ammoniacal sulfate solutions prepared by leaching lateritic ores with an aqueous ammonium hydroxide-ammonium sulfate leach liquor have the following illustrative compositions:

| | grams per liter |
|---|---|
| total ammonia | 50–100 |
| sulfate, as $SO_4$ | 100–240 |
| nickel | 5–20 |
| cobalt | 0.2–2 |

while those prepared by the dissolution or redissolution technique described above have the following illustrative compositions:

| | grams per liter |
|---|---|
| total ammonia | 10–200 |
| sulfate, as $SO_4$ | 10–100 |
| nickel | 0.2–100 |
| cobalt | 0.2–100 |

In reporting the analyses of these ammoniacal solutions, it is customary among those skilled in the art to express the total ammonia content in terms of gpl $NH_3$. It should be understood, however, that only a small fraction of the total ammonia content is in the form of $NH_3$. Combined ammonia is present in ammonium hydroxide ($NH_4OH$) and in the ammonium salts such as ammonium carbonate $(NH_4)_2CO_3$, ammonium chloride $NH_4Cl$ and ammonium sulfate $(NH_4)_2SO_4$, as well as in the complex metal ions in solution. The complex metal ions which are known to exist in these solutions include $Ni(NH_3)(H_2O)_5^{++}$, $Ni(NH_3)_2(H_2O)_4^{++}$, $Ni(NH_3)_3(H_2O)_3^{++}$, $Ni(NH_3)_4(H_2O)_2^{++}$, $Ni(NH_3)_5(H_2O)^{++}$, $Ni(NH_3)_6^{++}$, $Co(NH_3)_5(H_2O)^{+++}$ and $Co(NH_3)_6^{+++}$. Other complex metal ions which may be present include $Ni(NH_3)(H_2O)_4(OH)^+$, $Ni(NH_3)_2(H_2O)_3(OH)^+$, $Ni(NH_3)_3(H_2O)_2(OH)^+$, $Ni(NH_3)_4(H_2O)(OH)^+$, $Ni(NH_3)_5(OH)^+$, and the like The pH of the various ammoniacal solutions is normally above 7, and preferably above 8. Their free ammonia content is usually about 7 gpl $NH_3$ or less, indicating that only about 65–70% of the dissolved nickel or less is present as higher nickel-ammonia complexes.

Preferred ammoniacal solutions are the ammoniacal carbonate solutions in general, and ammoniacal sulfate solutions produced by the dissolution of a mixture of nickel sulfide and cobalt sulfide in an aqueous solution of ammonium hydroxide and ammonium sulfate, or in aqueous sulfuric acid followed by adjustment of the solution pH to above 8 with ammonia.

Gaseous ammonia, preferably of high purity, e.g. 95% or more by volume $NH_3$, or a strong solution of aqueous ammonia, e.g at least 33% by weight total ammonia or more, are preferred sources of free amonia for increasing the proportion of higher to lower nickel-ammonia complexes in solution to at least about 85%.

The addition of the gaseous ammonia or strong solution of aqueous ammonia to the ammoniacal solution must occur at some point prior to carrying out the sulfiding operation. The selection of a suitable point of addition and the specific method of addition will depend on various process considerations such as the equipment used, availability of ammonia, sources of ammonia, etc. Preferably, gaseous ammonia is injected just prior to carrying out the sulfiding operation.

The amount of gaseous ammonia, or strong solution of aqueous ammonia, injected can vary depending on such factors as the composition of the solution treated and the strength of the gaseous ammonia or strong solution of aqueous ammonia used. But in any event, enough ammonia is added to increase the amount of dissolved nickel present as higher nickel-ammonia complexes to at least about 85%. Preferably enough gaseous ammonia, or strong solution of aqueous ammonia, is added to increase the percentage of the dissolved nickel in the form of higher nickel-ammonia complexes to at least about 90%, and normally to about 90 to 98%. Under these preferred conditions, the subsequent sulfiding produces precipitates containing as much as about 50% more cobalt and 20% less nickel than sulfide precipitates obtained by conventional methods. It is of course possible to operate with enough addition of gaseous ammonia, or strong solution of aqueous ammonia, to raise the percentage of higher nickel-ammonia complexes in solution even higher than 98%, e.g., to about 99.8%, with corresponding substantial improvements of selectivity in the subsequent sulfiding. However, if too much gaseous ammonia, or strong solution of aqueous ammonia, is injected, ammonia losses due to evaporation can become a problem. Therefore, for economic reasons only, it is not ordinarily desirable to add gaseous ammonia, or strong solution of aqueous ammonia beyond that required to raise the percentage of higher nickel-ammonia complexes much higher than about 98–99%.

Ilustratively, satisfactory results are achieved when the invention is practiced at temperatures of about 35° to 200° F. For economic reasons, the invention is preferably practiced at the lowest possible temperature which does not necessitate external cooling, e.g., 60° to 140° F. Operating pressures are not critical, with atmospheric pressure being preferred.

The percentage of higher nickel-amonia complexes in solution can be conveniently measured by inserting a specific ion electrode, of the type that detects only the $NH_3$ species in solution, into the solution prior to the sulfiding and reading the free ammonia content which is then correlated to the percentage of higher nickel-ammonia complexes present in the solution using the graph of FIG. 1. A preferred electrode for this purpose is an ammonia electrode, having a gas diffusion membrane, such as the one commercially available from Orion Research Incorporated under the designation Ammonia Electrode Model 95–10. Electrodes such as this are specific for $NH_3$ in solution, sensing the level of dissolved free ammmonia in solutions such as those to which the invention is applied. Techniques for using such electrodes to measure free ammonia levels are well known to those skilled in the art. It can be seen from FIG. 1 that if this method is chosen for the measurement of the increase in the proportion of higher-to-lower nickel ammonia complexes, the ammonia injection prior to sulfidng is continued until a free ammonia content between about 10 and 30, and preferably between about 13 and 22, grams per liter is provided in the solution. It will be seen that this far exceeds the free ammonia content of conventional ammoniacal leaching solutions which usually contain only about 7 grams per liter or less of free ammonia.

The percentage of higher nickel-ammonia complexes in solution may also be measured by sampling the solution prior to sulfiding in a spectrophotometer such as Hitachi Spectrophotometer Model No. EPS-3T and reading the average wave length at which maximum absorption of the light beam passed through the solution occurs. This value, λmax, is then correlated to the percentage of higher nickel-ammonia complexes present in the solution using the graph of FIG. 2. It can be seen from FIG. 2 that when the measured λmax values of the solution are between about 585 and 605 millimicrons (one millimicron, mμ, equals $10^{-9}$ meters), about 85 to 99.3% of the dissolved nickel is present in the form of the desired higher nickel-ammonia complexes, whereas at measured λmax values beween about 588 and 601 mμ, about 90 to 98% of the dissolved nickel is present in the form of the desired higher nickel-ammonia complexes. Therefore, if a spectrophotometric technique is used to measure the increase in the proportion of higher nickel-ammonia complexes to lower nickel-ammonia complexes achieved by the practice of the invention, the ammonia addition prior to sulfiding should be continued until the solution has a measured λmax between about 585 and 605 mμ, and preferably between abut 588 and 601 mμ.

The λmax values referred to herein are spectrophotometric λmax values which have been measured against a standard solution containing cobalt-ammonia complexes of the same type and in the same proportion as those normally found in the nickel and cobalt enriched ammoniacal solutions used in the present invention. This is done because the spectrophotometer reading normally reflects the presence of both the nickel and cobalt-ammonia complexes in solution. However, when the λmax value is measured against a standard solution of cobalt-ammonia complexes, the spectrophotometer reading reflects only the difference between the sample and the standard solution, a difference attributable solely to the nickel-ammonia complexes which are not present in the standard solution.

Standard solutions of the cobalt-ammonia complexes can be prepared in several ways. For example, a solution containing the desired amount of cobalt-ammonia complexes can be synthetically prepared in accordance with procedures known to those skilled in the art. Preferably, however, a portion of the ammoniacal solution whose nickel-ammonia complex level is to be measured is treated with any of a variety of water-immiscible organic extractants which are known to those skilled in the art to cause the selective extraction of either the nickel or the cobalt values from the solution. One such extractant which is known to selectively extract nickel values comprises an oxime compound dissolved in a water immiscible organic solvent such as kerosene. The oxime compound is commercially available from General Mills Corporation under the designation LIX-64N. After treatment of the ammoniacal solution with the extractant, the aqueous and organic phases are separated, with the nickel values in organic phase and the cobalt values in the aqueous phase. The aqueous phase containing the cobalt is then used as the standard solution against which the λmax of the solution is measured. The spectrophotometer reading obtained reflects only the λmax value attributable to the nickel-ammonia complexes in the solution.

For the case where the ammoniacal solution whose λmax is to be determined has a low cobalt content, e.g., ¼ grams per liter or less, there is normally no need to measure the λmax value against a standard solution containing cobalt-ammonia complexes since the nickel content will normally be so high relative to the cobalt content that the spectrophotometer will produce essentially the same λmax in either case. However, as the amount of cobalt in solution increases, it becomes progressively more important that the λmax values be measured against a standard solution of cobalt-ammonia complexes to insure that the measured λmax values reflect only the contribution of the nickel-ammonia complexes.

The graphs of FIGS. 1 and 2, which are based on an ammoniacal carbonate solution, were prepared as follows. The formation constants of the various nickel-ammonia complexes in aqueous ammoniacal solutions are published in the literature. See, for example, "Metal Ammine Formation In Aqueous Solution - Theory Of the Reversible Step Reactions" by Jannik Bjerrum, P. Haase and Son, Copenhagen (1941), pp. 180–189 and particularly p. 188. From these constants, the equilibrium concentrations of each nickel-ammonia complex present in an aqueous ammoniacal carbonate solution can be readily calculated, in accordance with procedures known to those skilled in the art, from the known concentrations of the $NH_4OH$,$(NH_4)_2CO_3$, $NiCO_3$ and free ammonia in the solution. The percentage of nickel present as the higher nickel-ammonia complexes is obtained by simply adding up the individual concentrations of the complexes in which the number of $NH_3$ molecules is greater than 3.

Thus four ammoniacal carbonate solutions were prepared as follows, and the percentage of nickel present as the higher nickel-ammonia complexes was computed, using the known complex formation constants and the concentrations of $NH_4OH$, $(NH_4)_2CO_3$, $NiCO_3$ and free ammonia, to be 58.6%, 67.7%, 94.0% and 99.4%, respectively.

58.6% Higher Nickel-Ammonia Complexes

A solution containing 58.6% of the complexed nickel in the form of higher nickel-ammonia complex was prepared by adding 46.4 grams of $NH_4OH$, 152 grams of $(NH_4)_2CO_3$ and 20 grams of $NiCO_3$ to one liter of distilled water.

67.7% Higher Nickel-Ammonia Complexes

A solution containing 67.7% of the complexed nickel in the form of higher nickel-ammonia complex was prepared by adding 79.8 grams of $NH_4OH$, 130 grams of $(NH_4)_2CO_3$ and 20 grams of $NiCO_3$ to one liter of distilled water.

94.0% Higher Nickel-Ammonia Complexes

A solution containing 94.0% of the complexed nickel in the form of higher nickel-ammonia complex was prepared by adding 113 grams of $NH_4OH$, 102 grams of $(NH_4)_2CO_3$ and 20 grams of $NiCO_3$ to one liter of distilled water.

99.4% Higher Nickel-Ammonia Complexes

A solution containing 99.4% of the complexed nickel in the form of higher nickel-ammonia complex was prepared by adding 173.0 grams of $NH_4OH$, 48 grams of $(NH_4)_2CO_3$ and 20 grams of $NiCO_3$ to one liter of distilled water.

The measured free ammonia content and λmax value of each solution were as follows:

| % Higher Nickel-Ammonia Complexes In Solution | Free Ammonia, expressed as gpl $NH_3$ | λmax (mμ) |
|---|---|---|
| 58.6 | 3.0 | 615 |
| 67.7 | 7.0 | 610 |
| 94.0 | 13.0 | 600 |
| 99.4 | 24.0 | 590 |

The above data were then used to prepare the correlations of FIGS. 1 and 2. Although FIGS. 1 and 2 are based on an ammoniacal carbonate solution, essentially the same data is obtained from other ammoniacal solutions such as the ammoniacal chloride and ammoniacal sulfate solutions.

The method of this invention is preferably carried out in a continuous manner. The injection of the gaseous ammonia or strong solution of aqueous ammonia, into the ammoniacal solution can be conveniently controlled by determining the free ammonia concentration or the light absorption characteristics at a point beyond the point of injection with a specific ion electrode or a spectrophotometer, as the case may be, and allowing only enough ammonia injection to increase the proportion of higher nickel-ammonia complexes to lower nickel-ammonia complexes in solution to the point where at least about 85% of the dissolved nickel is in the form of higher nickel-ammonia complexes. The free ammonia concentration or λmax value is measured at a point beyond the point of ammonia injection but prior to the sulfiding operation.

It will now be apparent to those skilled in the art that the measurement of the percentage of higher nickel-ammonia complexes and the regulation of the injection of gaseous ammonia, or strong solution of aqueous ammonia, prior to sulfiding can be readily designed to conveniently control these operations automatically, using known principles of process instrumentation. Thus the injection of the gaseous ammonia, or aqueous solution of ammonia, could be made to operate on a demand basis depending on the reading obtained by the spectrophotometer or specific ion electrode, as the case may be.

Once the solution has been treated with a sufficient external addition of the free ammonia producing additive to assure that at least about 85% of the dissolved nickel is present as higher nickel-ammonia complexes, it is subjected to a controlled sulfiding to selectively precipitate the cobalt as cobalt sulfide, after which the nickel-rich mother liquor is separated from the cobalt-rich sulfide precipitate. The controlled sulfiding is carried out by contacting the pre-treated solution with any of a number of well-known sulfiding agents which are known to precipitate cobalt as cobalt sulfide. Some illustrative sulfiding agents include hydrogen sulfide ($H_2S$), sodium sulfide ($Na_2S$), ammonium sulfide[$(NH_4)_2S$], amonium hydrosulfide ($NH_4HS$), and the like. Enough sulfiding agent is ordinarily used to provide a sulfur-to-cobalt molar ratio of between about 2 and 4. Preferably, hydrogen sulfide is employed at a sulfur-to-cobalt molar ratio of about 3.5.

The separation of the nickel-rich mother liquor from the cobalt-rich sulfide precipitate, after the controlled sulfiding, is carried out in any manner known to be effective in separating precipitates from slurries of this type. Preferably, the sulfided slurry is sent to a thickener where a nickel-rich mother liquor is produced as the overflow and a cobalt-rich sulfide precipitate is produced as the underflow. The separation and recovery of the nickel and cobalt values from the sulfided slurry can, of course, be carried out in any manner known to those skilled in the art. Thus the sulfided slurry may be advantageously thickened to a solids content of about 5% by weight and then treated with air to further improve the selectivity of the sulfiding operation as described in U.S. Pat. No. 3,720,750. Similarly, the slurry can be treated in any other manner known to improve the separation and recovery of nickel and cobalt from slurries produced by the controlled sulfiding of ammoniacal solutions of these metals.

The following comparative examples are provided to further illustrate the invention.

EXAMPLES

A stock aqueous ammoniacal carbonate solution containing 10 gpl (grams per liter) nickel and 0.45 gpl of cobalt was used to demonstrate the effectiveness of the invention. The solution had a total ammonia content of 60 gpl, a free ammonia content of 7 gpl, and a pH of 9. This solution is typical of those produced by oxygen leaching of reduced nickeliferous ores with an ammoniacal carbonate leach solution.

In Test No. 1, 500 milliliters of this solution were sulfided in a stirred reactor using hydrogen sulfide as the sulfiding agent in a sulfur-to-cobalt molar ratio of 3.5. The percentage of dissolved nickel in the form of nickel-ammonia complexes prior to sulfiding was determined with a Hitachi Spectrophotometer Model No. EPS-3T and also with an Orion Ammonia Electrode Model 95–10, as discussed above. The spectrophotometer print-out indicated a λmax value of 615 millimicrons while the electrode measured a free ammonia content of 7 gpl. These values indicate (see FIGS. 1 and 2) that only about 67% of the dissolved nickel was present as higher nickel-ammonia complexes. The resultant slurry was filtered and the filtrate and sulfide precipitate analyzed for nickel and cobalt.

In Test No. 2, gaseous ammonia was added to 500 mls of the same stock solution used in Test No. 1 just prior to sulfiding until the spectrophotometer recording indicated a λmax value of only 603 millimicrons. A free ammonia reading was also taken at this point with the specific ion electrode, and showed a free ammonia content of 10.3 gpl. These values indicate (see FIGS. 1 and 2) that about 88% of the dissolved nickel was present as higher nickel-ammonia complexes. Sulfiding, filtration, and analyses were then carried out as in Test No. 1.

In Test No. 3, ammonium carbonate $(NH_4)_2CO_3$ was added to 500 mls of the same stock solution used in Test No. 1 just prior to sulfiding in an amount sufficient to raise its total ammonia content to the same level as in Test No. 2, i.e. 80 gpl. The spectrophotometer print-out indicated a λmax value of 615 mμ. A reading was taken with the specific ion electrode and the free ammonia content was 7 gpl. These values indicate (see FIGS. 1 and 2) that about 67% of the dissolved nickel was present as higher nickel-ammonia complexes. Sulfiding, filtration, and analyses were then carried out as in Test No. 1. The data obtained in the three tests are presented in Table 1 below.

TABLE 1

| | BEFORE SULFIDING | | | | | | AFTER SULFIDING | | | | | |
|---|---|---|---|---|---|---|---|---|---|---|---|---|
| Test No. | Total Ammonia, expressed as gpl $NH_3$ | Free Ammonia, expressed as gpl $NH_3$ | λmax (mμ) | % of higher nickel-ammonia, complexes in solution | Nickel in solution (gpl) | Cobalt in solution (gpl) | Nickel in filtrate (gpl) | Cobalt in filtrate (gpl) | Ni/Co in filtrate | Nickel in precipitate (weight %) | Cobalt in precipitate (weight %) | Ni/Co in precipitate |
| 1 (control) | 60 | 7.0 | 615 | 67 | 10 | .45 | 8.9 | 0.100 | 89 | 36.5 | 13.5 | 2.7 |
| 2 (invention) | 80 | 10.3 | 603 | 88 | 10 | .45 | 9.2 | 0.011 | 836 | 30.2 | 19.8 | 1.5 |
| 3 (control) | 80 | 7.0 | 615 | 67 | 10 | .45 | 8.9 | 0.100 | 89 | 36.5 | 13.5 | 2.7 |

The results obtained in Test No. 2 illustrate the vast improvement in the selectivity of cobalt precipitation achieved by increasing the proportion of higher nickel-ammonia complexes in solution prior to sulfiding, in accordance with the method of the invention.

Test No. 3 illustrates that adding ammonia in a form (ammonium carbonate) which changes only the total ammonia concentration but not the free ammonia content or the proportion of higher nickel-ammonia complexes in solution, has virtually no effect on the selectivity of cobalt precipiation. It should be noted that although the solutions in Tests Nos. 2 and 3 had an identical total ammonia content of 80 gpl, the improved selectivity in the sulfiding step was observed only in Test No. 2 where the free ammonia level was 10.3 gpl as compared to only 7 gpl in Test No. 3.

The data of Table 1 effectively demonstrate that when the method of the invention was used (Test No. 2), 25% more dissolved cobalt (0.439 gpl vs 0.350 gpl) was precipitated from the liquor than when the method was not used (Tests Nos. 1 and 3). As a result, the precipitate of mixed nickel and cobalt sulfide obtained had close to 47% more cobalt (19.8% vs. 13.5%) than the precipitates obtained by the same sulfiding opration but without the use of the method of the invention. Similarly, in Test No. 2, 27% less nickel (0.8 gpl vs. 1.1 gpl) precipitated while the precipitate contained 17% less nickel (30.2% vs. 36.5%) than the precipitates in Tests Nos. 1 and 3. The effectiveness is perhaps best emphasized by the fact that the nickel to cobalt ratio of the filtrate in Test No. 2 was almost 10 times greater (836 vs. 89) than that of Tests Nos. 1 and 3 while the nickel to cobalt ratio in the precipitate was only about half that of Tests Nos. 1 and 3.

The above examples and other specific and detailed information presented above were by way of illustration only, and such alterations and modifications thereof as would be apparent to those skilled in the art are deemed to fall within the scope and spirit of the invention, bearing in mind that the invention is defined only by the following claims.

What is claimed is:

1. In a method for separating cobalt from an ammoniacal solution containing dissolved therein cobalt and nickel, comprising treating said solution with a sulfiding agent which provides sulfide ions in said solution in sufficient amount to selectively precipitate the cobalt as cobalt sulfide, the improvement which comprises treating the solution, prior to treatment with the sulfiding agent, with a material capable of providing free ammonia in solution, in an amount sufficient to increase the proportion of nickel present as higher nickel-ammonia complexes to at least about 85% of the total nickel in solution.

2. The method of claim 1 wherein said ammoniacal solution is an ammoniacal carbonate solution prepared by leaching a reduced nickeliferous ore containing nickel and cobalt values with an aqueous ammoniacal carbonate solution.

3. The method of claim 1 wherein said ammoniacal solution is an ammoniacal carbonate solution prepared by dissolving basic nickel and cobalt carbonates in an aqueous ammonium hydroxide-ammonium carbonate solution.

4. The method of claim 1 wherein said ammoniacal solution is an ammoniacal sulfate solution prepared by the dissolution of a mixture of nickel sulfide and cobalt sulfide in aqueous sulfuric acid followed by adjustment of the solution pH to above 7 with ammonia.

5. The method of claim 1 wherein said ammoniacal solution is an ammoniacal carbonate solution or an ammoniacal sulfate solution.

6. The method of claim 1 wherein the material capable of providing free ammonia in solution is gaseous ammonia or a solution of aqueous ammonia having a total ammonia content of at least about 33% by weight.

7. In a method for separating cobalt from an ammoniacal solution containing dissolved therein cobalt and nickel, comprising treating said solution with a sulfiding agent which provides sulfide ions in said solution in suficient amount to selectively precipitate the cobalt as cobalt sulfide, the improvement which comprises treating the solution, prior to treatment with the sulfiding agent, with gaseous ammonia or a strong solution of aqueous ammonia, in an amount sufficient to increase the proportion of nickel present as higher nickel-ammonia complexes to about 90 to 98% of the total nickel in solution.

8. In a method for separating cobalt from an ammoniacal solution containing dissolved therein cobalt and nickel, comprising treating said solution with a sulfiding agent which provides sulfide ions in said solution in sufficient amount to selectively precipitate the cobalt as cobalt sulfide, the improvement which comprises treating the solution, prior to treatment with the sulfiding agent, with a material capable of providing free ammonia in said solution, in an amount sufficient to provide a free ammonia content in the solution of at least about 10 grams per liter.

9. The method of claim 8 wherein the amount of said material is sufficient to provide a free ammonia content of about 10 to 30 grams per liter.

10. The method of claim 8 wherein the amount of said material is sufficient to provide a free ammonia content of about 13 to 22 grams per liter.

11. The method of claim 8 wherein the solution, prior to treatment with the material capable of providing free ammonia therein, has a free ammonia content of less than about 7 grams per liter.

12. In a method for separating cobalt from an ammoniacal solution containing dissolved therein cobalt and nickel, comprising treating said solution with a sulfiding agent which provides sulfide ions in said solution in sufficient amount to selectively precipitate the cobalt as cobalt sulfide, the improvement which comprises treating the solution, prior to treatment with the sulfiding agent, with a material capable of providing free ammonia in solution until the wavelength at which maximum light absorption by the solution occurs is about 605 millimicrons or lower.

13. The method of claim 12 wherein the wavelength is about 585 to 605 millimicrons.

14. The method of claim 12 wherein the wavelength is about 588 to 601 millimicrons.

15. The method of claim 12 wherein prior to treating the solution with the material capable of providing free ammonia therein, the wavelength at which maximum light absorption by the solution occurs is greater than about 615 millimicrons.

16. In a method for separating cobalt from an ammoniacal solution containing dissolved therein cobalt and nickel, comprising treating said solution with a sulfiding agent which provides sulfide ions in said solution in sufficient amount to selectively precipitate the cobalt as cobalt sulfide, the improvement which comprises measuring the free ammonia content of the solution prior to sulfiding and treating the solution, prior to sulfiding, with a material capable of providing free ammonia in the solution, in an amount sufficient to raise the measured free ammonia content to about 3 to 7 grams per liter.

17. The method of claim 16 wherein the ammoniacal solution, prior to treatment with the material capable of providing free ammonia therein, has a free ammonia content of less than about 2 grams per liter.

18. In a method for separating cobalt from an ammoniacal carbonate solution containing dissolved therein cobalt and nickel, comprising treating said solution with a sulfiding agent which provides sulfide ions in said solution in sufficient amount to selectively precipitate the cobalt as cobalt sulfide, the improvement which comprises passing light of varying wavelength through the solution and measuring the average wavelength of maximum light absorption by the solution prior to treatment with sulfiding agent, and treating the solution, prior to sulfiding, with gaseous ammonia or a solution of aqueous ammonia until said measured average wavelength is reduced to about 585 to 605 millimicrons.

19. The method of claim 18 wherein the average wavelength of maximum light absorption of the solution, prior to treatment with the material capable of providing free ammonia therein, is greater than about 615 millimicrons.

* * * * *